United States Patent [19]

Yamashita

[11] Patent Number: 5,037,263

[45] Date of Patent: Aug. 6, 1991

[54] VEHICLE CONVEYER FOR A MULTI-STORY PARKING GARAGE

[75] Inventor: Kyoichi Yamashita, Kanagawa, Japan

[73] Assignee: Koyojidoki Company Limited, Yokohama, Japan

[21] Appl. No.: 511,418

[22] Filed: Apr. 20, 1990

[30] Foreign Application Priority Data

Apr. 21, 1989 [JP] Japan ..... 1-99939

[51] Int. Cl.[5] ..... E04H 6/18; E04H 6/06

[52] U.S. Cl. ..... 414/254; 414/256; 414/252

[58] Field of Search ..... 414/254, 227, 231, 232, 414/252, 253, 255, 256, 260, 261, 286, 281

[56] References Cited

U.S. PATENT DOCUMENTS

| | | | |
|---|---|---|---|
| 2,707,054 | 4/1955 | Alimanestiano | 414/254 |
| 2,840,248 | 6/1958 | Grove et al. | 414/256 |
| 2,858,032 | 10/1958 | Morley | 414/254 X |
| 3,161,303 | 12/1964 | Burrows | 414/254 |
| 3,301,413 | 1/1967 | Coursey | 414/254 |
| 3,786,930 | 1/1974 | Obregon | 414/254 X |
| 4,079,847 | 3/1978 | Kochanneck | 414/256 |
| 4,322,804 | 3/1982 | Evans | 414/231 X |
| 4,738,579 | 4/1988 | Byrd | 414/231 X |
| 4,793,760 | 12/1988 | Valli | 414/254 |

*Primary Examiner*—Frank E. Werner
*Assistant Examiner*—Brian K. Dinicola
*Attorney, Agent, or Firm*—Irell & Manella

[57] ABSTRACT

This invention relates to a multi-story parking garage which includes a plurality of parking garage floors and a plurality of parking spaces on each of the floors. The garage is further comprised of interconnecting rails and tracks along which a vehicle conveyer device can move so as to transfer cars from an entrance of the garage to parking spaces in the garage on different floors of the garage and then remove the cars from the parking spaces and move them to the exit point of the garage. The vehicle conveyer is comprised of a flat car frame having a plurality of rollers connected thereto which can move along the rails. The flat car includes grooved surface areas which are positioned in a manner corresponding to the four wheels of a car. A shifter device is provided which is of a relatively short height so that it can move beneath a car by moving horizontally along a track and then move upward vertically. Two pairs of catcher arms positioned on a shifter device are pivotally connected and movable so that the arms can be extended downward so that prongs on the arms are buried within the grooves. The arms can then be raised out of the grooves forcing the vehicle upward. When held in an upward position, the vehicle can be positioned on a vehicle conveyer and placed in any given parking space within the garage. The components are connected to electrical signaling circuits which signaling circuits are interconnected with a computer so that the operation of the components and storing of the cars is done automatically.

7 Claims, 9 Drawing Sheets

VEHICLE CONVEYER FOR A MULTI-STORY PARKING GARAGE

CROSS-REFERENCE

This application is based on and claims priority to Japanese patent application 1-99939 under 35 USC §119, a certified copy of which is attached hereto and which application is incorporated herein by reference to disclose and describe the present invention.

FIELD OF THE INVENTION

The present invention relates generally to the field of vehicle conveyers used in multi-story parking garages. More specifically, the invention relates to devices capable of safely conveying a vehicle between the entrance and exit and the parking space of a multi-story parking garage at a relatively high rate of speed.

BACKGROUND OF THE INVENTION

In crowded industrial and highly populated areas, there is an increasing need for parking space. In an effort to solve that need, there have been developed a number of multi-story parking garages. Some such garages are so compact in configuration that the vehicles cannot be driven from the entrance to the parking space and then to the exit. The garages must be designed so that the vehicle can be mechanically moved by some conveyer means from the entrance to a parking space and then from that parking space to an exit. Comb-shaped catchers are used to convey vehicles within such compact parking garages. The comb-shaped catchers which convey vehicles may be divided generally into two categories.

One main category of the comb-shaped catchers is disclosed within Japanese UM Publication No. 54-62286. In this publication, there is disclosed a comb-shaped conveyer which includes plates that have teeth onto which the tires of the vehicle are driven. The plates are positioned parallel to each other on both sides of the vehicle conveyer and on the center of the respective parking space and may shift longitudinally, perpendicularly or transversely.

When a vehicle enters the parking space, the tires of the vehicle are driven onto the respective comb-shaped plate of the vehicle conveyer. The vehicle conveyer then lifts the vehicle sideways to the front of the arranged parking space. The floor of the parking space having the comb-shape plates thereon advances under the comb-shaped plates of the vehicle conveyer on which the vehicle is placed and the comb-shaped plates holding the vehicle may be shifted downward by utilizing the teeth of the comb-shaped plates. The vehicle is transferred from the comb-shaped plates of the conveyer to the comb-shaped plates of the parking space and shifted sideways towards the parking space. The vehicle conveyer with the comb-shaped plates passes through the comb-shaped plates of the parking space and then shifts downward in order to return. When leaving the parking space, the vehicle conveyer and parking space operate in a reverse fashion.

A second process for conveying vehicles within a multi-story parking garage is disclosed within Japanese Patent Publication 63-251576. This vehicle conveyer operates in a manner similar to that disclosed within the above-discussed publication JA 54-62286. However, in accordance with the device disclosed with in JA 63-251576, the comb-shaped plates of the vehicle conveyer on which the vehicle is placed shift toward the vehicle above the arranged parking space and then shifted downward, and by means of the teeth on the comb-shaped plates of the vehicle conveyer and pass through the space between the teeth of the comb-shaped plates of the parking space. Accordingly, the vehicle is transferred in a forward-direction position.

Conventional vehicle conveyers, such as described above, are designed so that the use of space is not efficiently utilized. Further, due to the configuration of the conveyers, they must operate at a relatively low rate of speed in order to insure safety. In addition, even after the power driving the conveyers is stopped, the mechanism still requires the use of a hand brake or some type of reduction gear in order to halt the operation of the device and insure that the vehicle remains stationary in its parking space. The present invention endeavors to eliminate and/or alleviate such problems and provide a parking conveyer system whereby the space is efficiently utilized, the vehicles are quickly moved from the entrance to the parking space and from the parking space to the exit and whereby they can be held securely in place without the use of extraneous braking operations.

SUMMARY OF THE INVENTION

The present invention is a vehicle conveyer device and system which is capable of conveying a vehicle automatically between the entrance or a multi-story parking garage and a parking space and from the parking space to the exit of the garage. The device is comprised of a flat car which shifts its course of direction within the multi-story parking garage and two pairs of sliding catcher arms. The vehicle conveyer advances into the space between the vehicle and the floor in order to pick up and hold the entire weight of the vehicle and fix the tires of the vehicle in place by the use of the catcher arms. The vehicle is then conveyed from the entrance of the garage to a parking space and arranged there in an efficient fashion. By reversing the action, the vehicle can be removed from the parking space and conveyed to the exit of the parking garage.

It is a primary object of the present invention to provide a vehicle conveyer which conveys various types of automobile vehicles efficiently from an entrance to a parking space within a multi-story parking garage and then moves the vehicles from the parking space to the exit of the garage in a safe and efficient manner.

Yet another object of the present invention is to provide such a vehicle conveyer device which is capable of moving vehicles quickly so as to substantially reduce the time necessary between moving the vehicle from the entrance to the parking space and from the parking space to the exit as compared with conventional conveyer devices within conventional multi-story parking garages.

An advantage of the present conveyer system is that it provides for greater safety regarding the secure storage of vehicles within multi-story parking garages.

A feature of the present invention is that the size of the parking space necessary for storing the vehicle may be reduced as compared with the size of the space necessary with conventional multi-story parking garages.

Another feature of the present invention is that the thickness of the floor of the parking space may be reduced as compared with the floor thickness of conventional parking spaces of multi-story parking garages.

These and other objects, advantages and features of the present invention will become apparent to those skilled in the art upon reading the details of the structure and operation as more fully set forth below, reference being made to the accompanying figures forming a part hereof.

BRIEF DESCRIPTION OF THE DRAWINGS

This invention may be better understood and its numerous objects and advantages will become apparent to those skilled in the art by reference to the accompanying drawings as follows.

DETAILED DESCRIPTION OF PREFERRED EMBODIMENTS

Before the present multi-story parking garage and vehicle conveyer device and system are described, it is to be understood that this invention is not limited to the particular component parts or process movements as such parts and movements may, of course, vary. It is also to be understood that the terminology used herein is for describing particular embodiments only and is not intended to be limiting since the scope of the present invention will be limited only by the appended claims.

Figure 1:
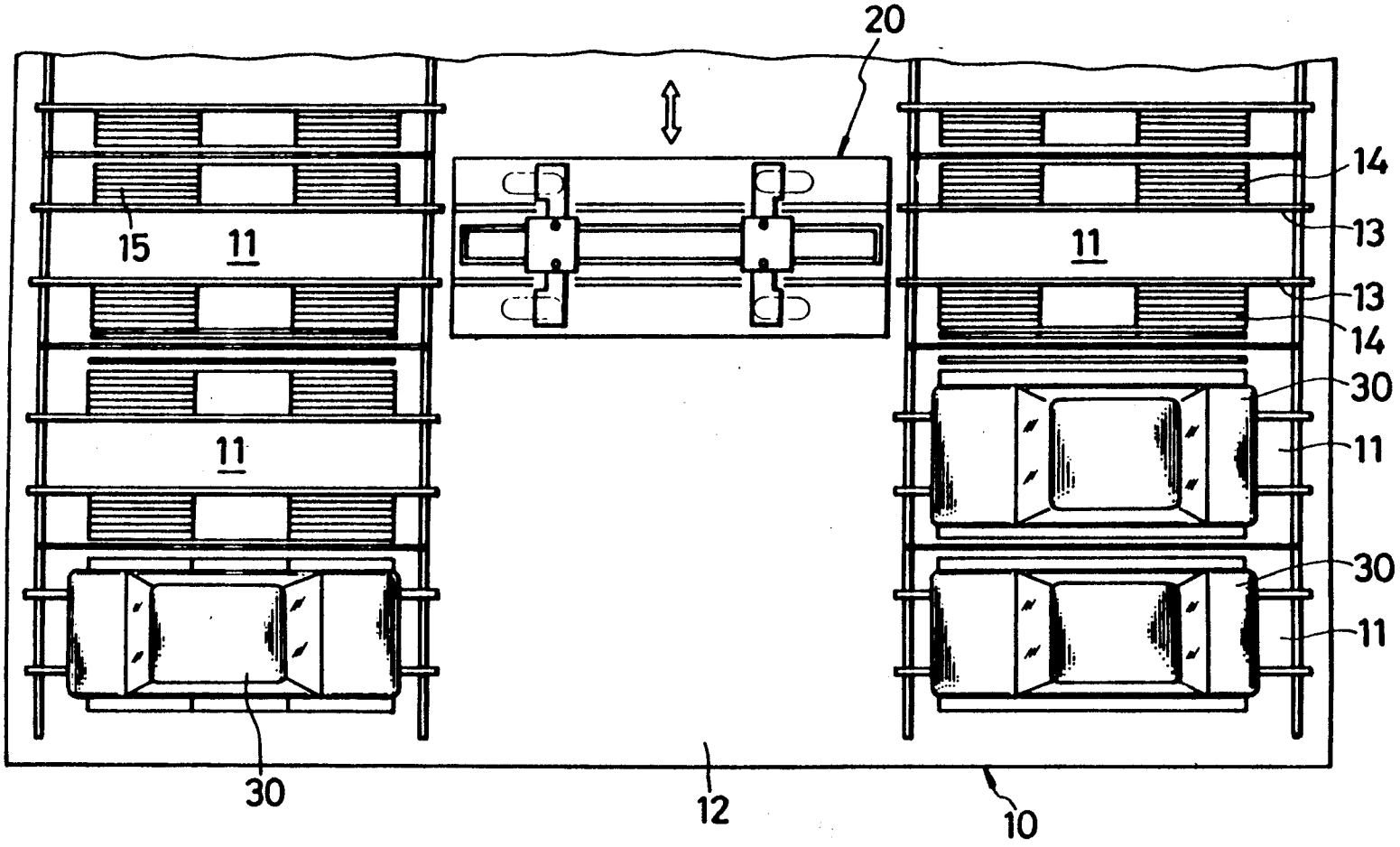
FIG. 1 is a partial plan top view of a parking garage showing a vehicle conveyer of the present invention.

Referring now to the drawings, FIG. 1 illustrates a partial plan view of a multi-story parking garage of the present invention. Within FIG. 1, cars 30 can be seen within parking spaces 11 of the garage 10 which may be underground, above ground or partially under and partially above ground. The garage will have a plurality of floors and each floor may have a plurality of parking spaces 11. A vehicle conveyer 20 is arranged within a center course 12. By using the conveyer 20 it is possible to move a given vehicle 30 from an entrance (not shown) to the closest possible available unoccupied parking space 11 and also to take a vehicle 30 from a parking space to an exit (also not shown) wherein the exit and the entrance may be the same.

Each of the parking spaces 11 are comprised of two parallel rails 13 and plates 14 having grooved surfaces. The plates 14 are positioned outside the parallel rails 13. There may be two plates each with two grooved surface areas or four plates each with a grooved surface area. The grooves run parallel to the rails 13. The respective tires of the vehicles 30 are generally positioned on the grooves 15 of the plate 14. Each plate 14 should be wide enough to provide support for the wheel of difference size vehicles 30. The space between the rails 13 is designed so as to have a concave or grooved shape and provide an open space for the smooth shifting of vehicles to and from a conveyer 20. In accordance with the present invention, the height of the parking space 11 (that is the distance between the top of the plate 14 and the ceiling) should be the minimum height required for the type of vehicles to be stored. Further, the plates 14 and supporting structure should be comprised of high grade metals which can be formed in a relatively thin structure, and still provide adequate strength for supporting the vehicles 30.

STRUCTURE OF THE VEHICLE CONVEYER 20

Figure 2:
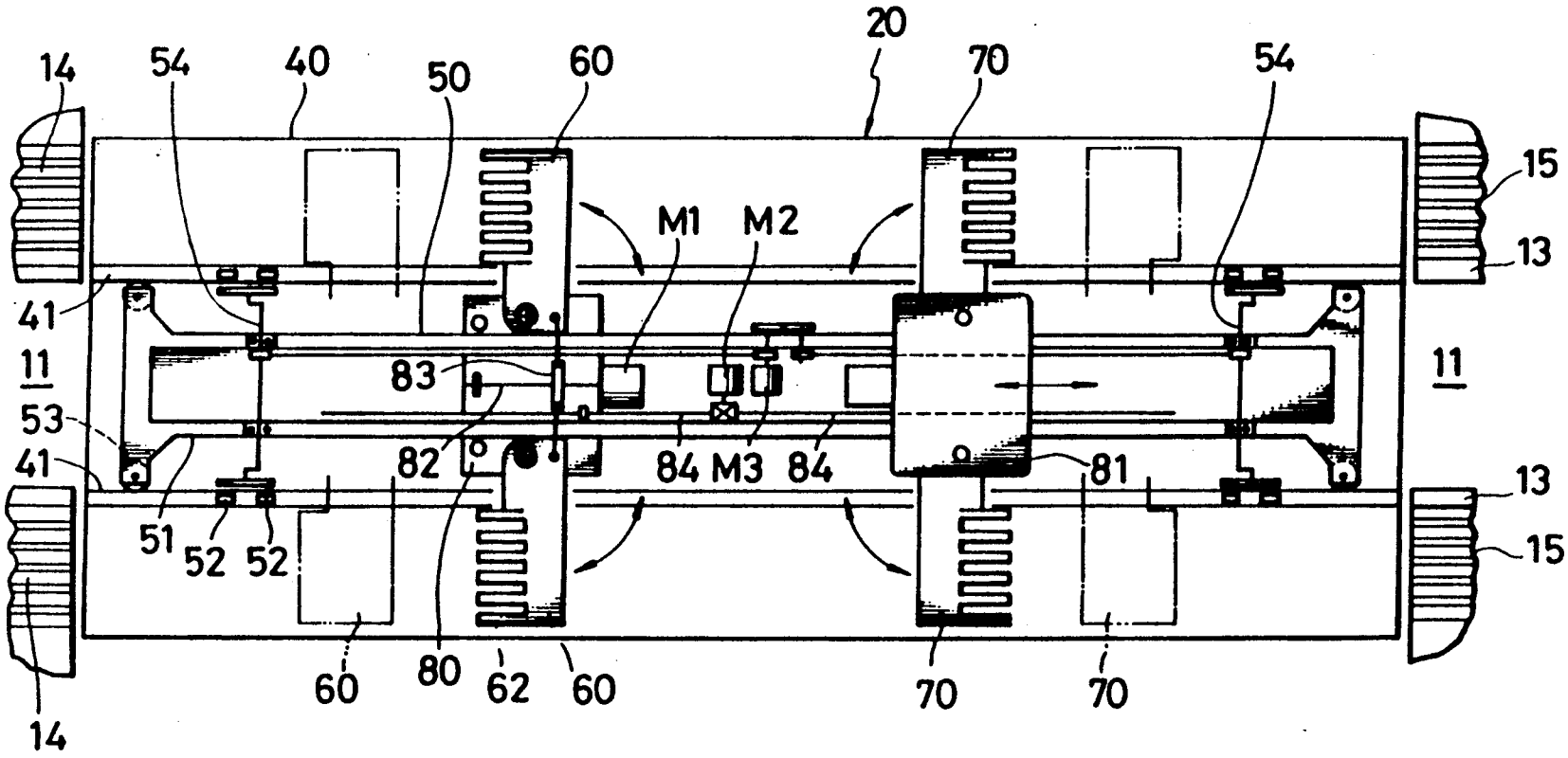
FIG. 2 is a whole plan view of the vehicle conveyer of the present invention showing catcher arms.

Referring to FIG. 2, there is shown an entire plan view of a vehicle conveyer 20 of the present invention. The vehicle conveyer 20 is comprised of a flat car 40 and a shifter 50 which is mounted on the flat car 40. The flat car 40 is comprised of a high grade, high strength metal, such as steel, and includes two parallel rails 41 which allow for the shifting, that is which allow for the horizontal movement of the vehicles 30 into and out of the parking spaces 11. The two rails 41 are arranged at equally spaced intervals as compared with the rails 13 on each of the parking spaces 11. The shifter 50 includes the elongated device positioned between the rails 41 and running parallel to the rails 41 along the entire length of the flat car 40. The shifter 50 can be utilized to move vehicles 30 the length of the flat car 40 into a parking space 11. The shifter 50 can move the arms 60 and 70 beneath the vehicle 30 and thus position the arms so that all of the wheels of the vehicle can be lifted simultaneously.

OPERATION OF THE SHIFTER

The shifter 50 is comprised of a frame 51 which includes two connecting crank shafts 54 and rollers 52. The connecting crank shafts 54 are rotatably provided at the front and rear portions of the frame 51. The sets of rollers 52 are connected with both sides of the connecting crank shafts 54. The rollers 52 are positioned so that they can move longitudinally along (and not off of) the rails 41. Use of drive connector means, well known to those skilled in the art, such as drive rollers, rack and pinion systems or chain and sprocket systems provide the shifter 50 with power so that it can move along the rails 41 in a position centrally located between parking spaces (as shown in FIG. 1) onto the rails 13 in the parking spaces 11. The movement is carried out in connection with the connecting crank shafts 54 and rollers 52 moving on the rails 41. In order to further stabilize and position the shifter 50, there are provided fixing rollers 53 at four points along the frame 51. The fixing rollers 53 are positioned apart from each other and extend outward from the frame 51 so as to contact the side portions of the rail 41. Accordingly, the combination of fixing rollers 53 and rollers 52 provide both vertical and horizontal stability to the movement of the frame 51 along the flat car 40 and into the parking space 11.

SECURING THE TIRES OF THE VEHICLES 30

As shown within FIG. 2, a pair of front catcher arms 60 and rear catcher arms 70 are provided at the front and rear ends of the frame 51. The pairs of catcher arms 60 and the pairs of catcher arms 70 are individually interconnected via an upper plate 81 (shown with arms 70) and a lower plate 80 (shown with arms 60). The upper plates 81 provide a cover for the catcher arm movement mechanism. The respective catcher arms may pivot through 90° of movement and provide for vertical lifting of the vehicles above the rails 41. Accordingly, a given vehicle may be lifted above the rails 41 or lowered down toward the rails 41 by use of the arms 60 and 70 (vertical movement) and moved along the vertical rails 41 by the shifter 50 (horizontal movement).

CONFIGURATION OF CATCHER ARMS 60 AND 70

By referring to a single catcher arm 60 as shown within FIGS. 3 and 4, the catcher arms (which are in pairs 60 and 70) will be described. The basic structure of the catcher arm 60 and its interconnecting components are shown perspectively within FIG. 3. This embodiment is a preferred configuration for a catcher arm 60 which should be comprised of high grade, high strength metals, such as tempered steel capable of supporting the weight of vehicles 30.

Figure 3:
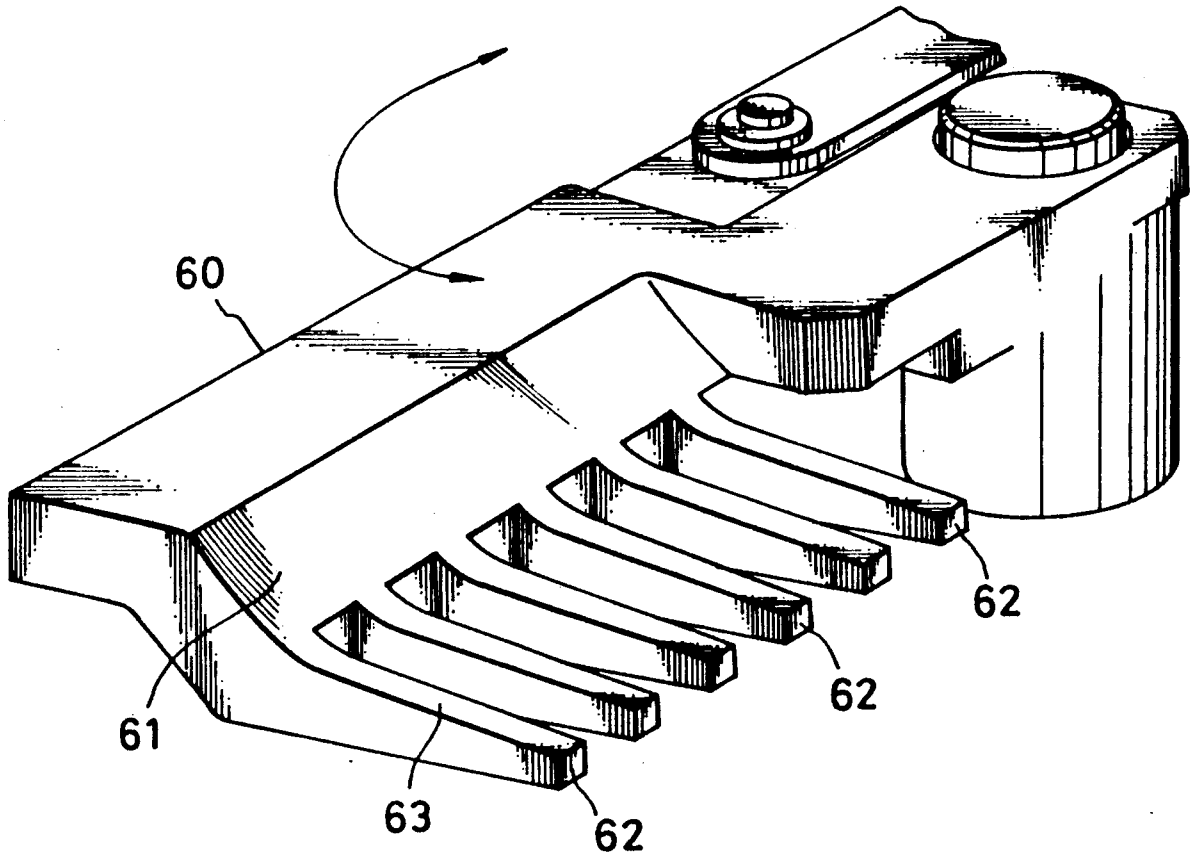
FIG. 3 is a perspective view of the catcher arms of the vehicle conveyer of the present invention.
Figure 4:
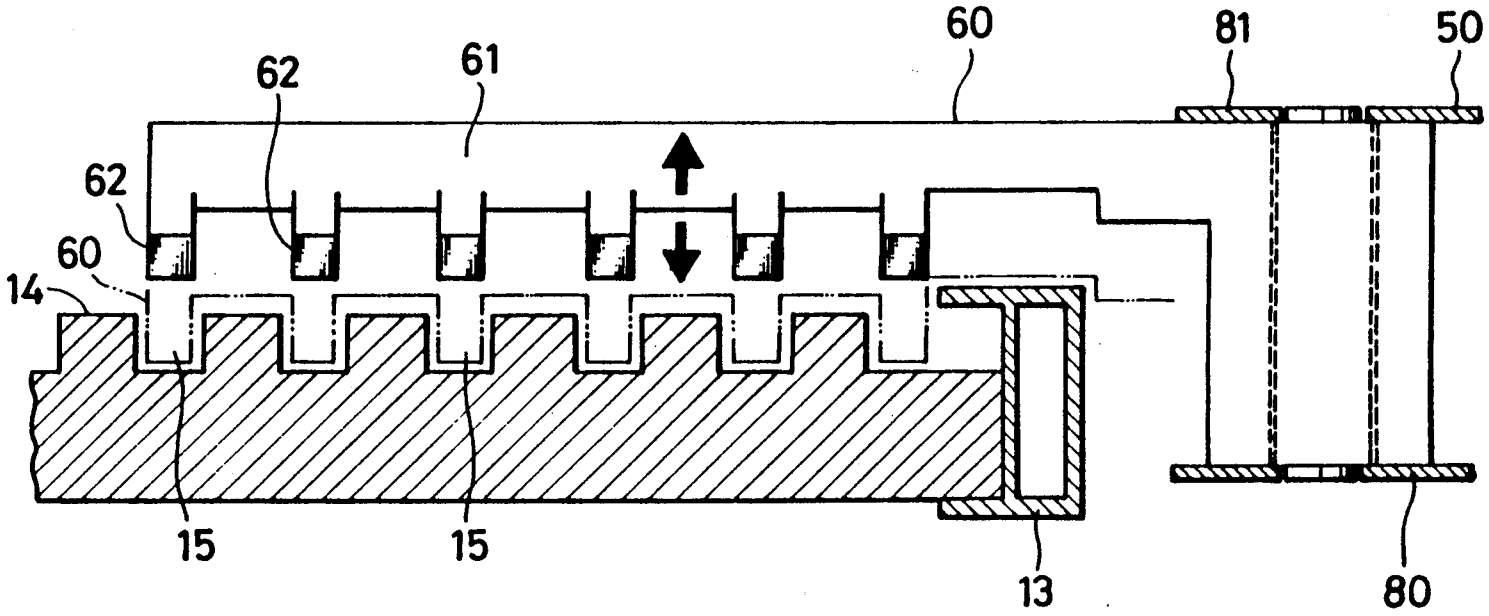
FIG. 4 is a partial cross-sectional plan view of a grooved surface plate of the present invention showing its relationship with the catcher arm prongs.

The arm 60 which is shown perspectively in FIG. 3 is shown by a transverse sectional view in FIG. 4 with the plate 14 having a grooved surface. The interrelationships between the catcher arm 60 and the plate 14 can be seen by viewing FIG. 4 in combination with FIG. 2.

As shown within FIG. 3, the catcher arm 60 is rotatably connected at one end. As shown within FIG. 4, the rotatable connection is with an upper plate 81 and a lower plate 80 which hold a connector pin in place which allows the arm 60 to pivot on the connector pin. The surface 61 (seen best in FIG. 3) of the arm 60 is the surface which contacts and secures the tire of the vehicle 30 preventing horizontal movement. The surface 61 is preferably directly connected to a plurality of prongs 62 which are placed at the front surface of the catcher arm 60 at regular intervals. The prongs 62 have an upper surface 63. The prongs 62 are designed to have the relatively smooth, straight, slanting surfaces 63 which may include anti-skid rough portions for securing the surface of a tire from a vehicle 30. The width of the prongs 62 is equal to or slightly smaller than the grooves 15 which are shown within FIG. 1 as part of the grooved surfaces of the plates 14 of each parking space 11. It is important that the prongs 62 are designed so that they can pass through and not interfere with the side surfaces of the grooves 15. More preferably, the prongs 62 and strip openings 15 are designed so as to smoothly move and intermesh with respect to each other.

OPEN AND CLOSING THE CATCHER ARMS

The means by which the catcher arms 60 and 70 open and close will now be described with reference to the drawings.

Firstly, one end of a front catcher arm 60 is ranged between an upper plate 81 and a lower plate 80 as shown within FIG. 2. The arms 60 are rotatably mounted in combination with these plates, as shown more clearly in FIG. 4, which shows the connector pin held between the plates 80 and 81. The front catcher arm 60 may be powered by a variety of different power sources, such as a motor M1 which may be positioned under the lower plate 80 and connected to the arms 60 via a connecting and power conveying means 83 as shown within FIG. 2. Both sides of the front catcher arm 60 are connected with a rotary shaft 82 and/or other means for providing the power of the motor M1 to the connecting and power conveying means 83. When the motor M1 is rotated, the respective catcher arms 60 are pivoted upwardly from a lower position through a 90° angle into an upward position. By reversing the direction of the motor, the arms can be pivoted and lowered from an upward position to a lower horizontal position whereby the prongs 62 mesh with the strip openings 15 as shown within FIG. 4. It is not necessary for the arms to move through an entire 90° pivot in order to obtain the objects of the invention which are to raise the tires of the vehicle and thus the vehicle off of a support and then relowering the vehicle onto a support. When a given catcher arm 60 has been closed, the prongs 62 can be positioned inside the rail 41 and when the respective catcher arms 60 are opened, the prongs 62 of the catching arms 60 can be positioned parallel to and in the grooves 15. Again, the operation of the catcher arms 70 is identical to that of the arms 60. However, it should be noted that is not absolutely necessary that the arms move at the same time, or to precisely the same degree provided that the car is lifted and positioned at an angle such that it is balanced and held securely by the arms.

SHIFTING THE CATCHER ARM

In addition to pivoting and thus lifting the vehicle tires, the catcher arms 60 and 70 may move on the rails of the flat car 40 and into the parking space 11 as it is best shown within FIG. 2. In order for the catcher arms 60 and 70 to move horizontally, it is best to provide a separate drive means such as a motor M2 which is shown in FIG. 2 as being positioned centrally with respect to the catcher arms 60 and 70. The motor M2 must be connected by some connecting and power transferring means such as a screw bar 84 through the connection with the bevel gears which are provided at the head of the shaft and the screw bar 84. The screw portion of the screw bar 84 may be put into the screw box (not shown) which is provided on the lower plate 80 with which the arms 60 and 70 are rotatably connected. In accordance with this specific embodiment, the screw box is designed as a nut which can rotate on the shaft of the motor M2. The screw bar 84 turns to shift the front and rear lower plates longitudinally through a connection with the bevel gears which are provided at the head of the shaft. The bevel gears and the screw bar 84 and the screw box may be arranged to shift the perspective lower plates 80 in the opposite direction. Accordingly, the front and rear catcher arms which are connected with the lower plate shift longitudinally in the opposite direction. The respective vehicle fixing surfaces 61 on the arms 60 have a stop sensor. This sensor detects a point of contact with the tire and the catcher arm and the stop sensor transmits a stop signal to the motor M2 and a start signal to the motor M1 which makes the catcher arms 60 and 70 open or close. The motor M2 which makes the catcher arms 60 and 70 shift longitudinally. Various types of electrical contact-type detecting means and/or other detecting means well known to those skilled in the art can be utilized in connection with this invention. The detecting means can, of course, be set to stop or start at any given point after receiving a given signal. For example, the detecting means can be set to stop a lifting of the vehicle after it reaches a certain degree of angle of catcher arm rotation which will provide the vehicle sufficient lift. Further, the arm detecting means can be set to stop the descent after the prongs 62 have descended so that they fit within the grooves 15 and the vehicle has been placed in a parking space 11. Detecting means can also be positioned so that the vehicle will be correctly positioned within the parking space 11 and such detecting means can be connected with the motor M2 so that the vehicle 30 is not moved to far into a parking space 11 so that it could be damaged by striking the end wall surface of the parking space 11.

THE ASCENT AND DESCENT MOVEMENT OF THE FRAME 51

Figure 5:
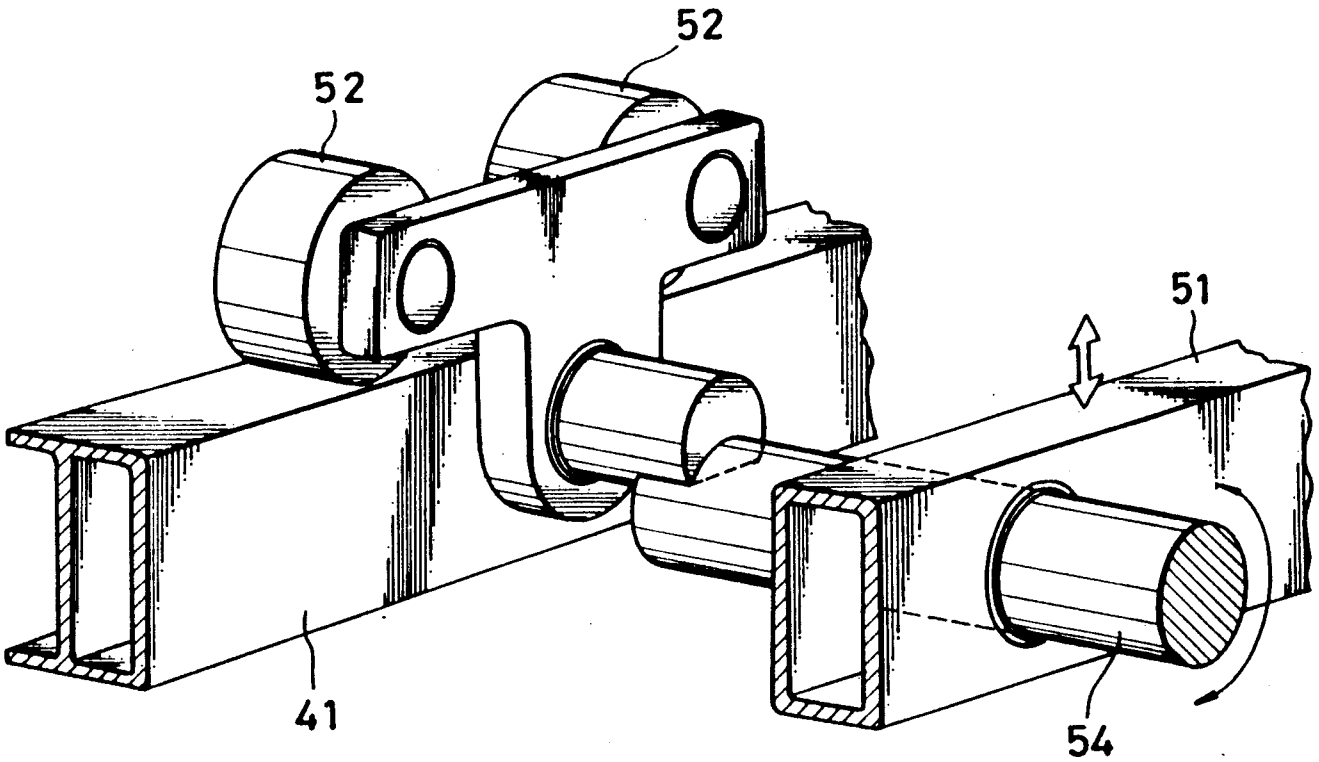
FIG. 5 is a perspective partial schematic view of a frame mechanism which provides the vertical movement to the frame.

By referring to FIGS. 2 and 5, the relative vertical movements of the shifter 50 and its surrounding frame 51 can be described. As previously indicated, the shifter 50 includes a frame 51 which is comprised of two connecting shafts 54 and rollers 52. The connecting shafts 54 are arranged to allow for the vertical movement (upward or downward) of the shifter 50. The crank shafts 54 are rotatably provided at the front and rear portion of the frame 51 and extend through the frame 51 as best seen within FIG. 5. Plural sets of rollers 52 are connected on both sides of the respective connecting shafts 54 so the rollers 52 are placed on and can move along the rails 41. The connecting crank shafts 54 rotate and are moved by a power source, such as a motor M3 (shown within FIG. 2) which is connected through a connecting and power transfer means, such as a chain 55 connected to a sprocket provided on the crank shafts 54. By rotating the crank shafts 54, the shifter 50 is designed to move vertically. The respective crank shafts 54 may rotate in either direction through a 180° arc. Accordingly, catcher arms 60 and 70 open or close within the range of the distance between the top center and bottom center of the frame 51. A variety of different mechanisms for moving the shifter 50 vertically will be recognized by those of ordinary skill in the art who have read this disclosure and seen the attached drawings.

OPERATION OF THE SHIFTER 50

Figure 6:
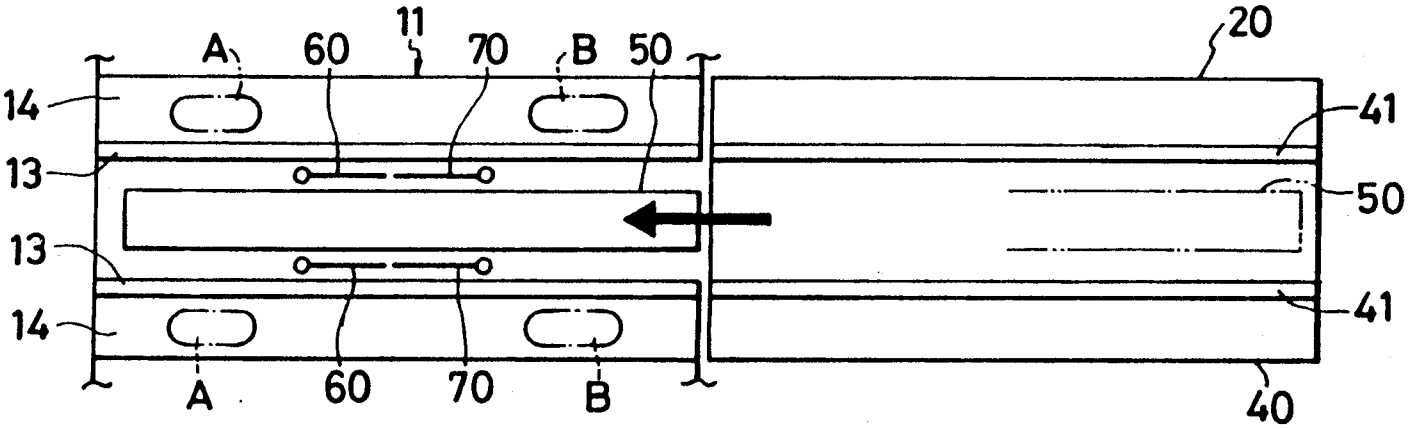
FIG. 6 is a plan view of the parking garage showing how the shifter moves horizontally into the parking space of the garage.

Referring now to FIGS. 6–11, the operation of the vehicle conveyer device of the present invention can be described wherein a particular vehicle 30 is moved into and out of a parking space 11. Referring to FIG. 6, a vehicle 30 (not shown) is positioned on the vehicle conveyer 20, so that the front tires are in positions A and A' and the rear tires are in positions B and B'. The vehicle 30 may be driven into this position on the vehicle conveyor 20 so that the four tires are placed in the correct positions above the catcher arms 60 and 70 (see FIG. 2). The vehicle conveyor 20 is then aligned with the parking space 11. When correctly aligned the arms 60 and 70 lift the vehicle and move the correctly aligned vehicle to its position above the parking space 11. At this position, the vehicle tires are positioned above the grooves 15 on the surface of plate 14 of the parking space 11. In a preferred embodiment of the invention, the sensors and drive means of the vehicle conveyer are interconnected with a computerized control means which directs the operation of the vehicle conveyer 20 with respect to both vertical and horizontal movement of the conveyer so as to place the vehicle 30 in the correct desired position.

During the horizontal and vertical movement of the vehicle conveyer 20, the catcher arms 60 and 70 are in a closed position within the parallel rails 41. The frame 51 of the vehicle conveyer 20 shifts and moves vertically upward with respect to the parallel rails 41 and the respective rails 13 of the parking space 11 in a direct and efficient manner. The shifter 50 on which the catcher arms 60 and 70 are closed then moves the vehicle conveyer 20 horizontally to the center of the parking space 11. This passes the rails 41 of the vehicle conveyer 20 as well as the rails 13 of the parking space 11 beneath the vehicle 30.

OPENING THE CATCHER ARMS

Figure 7:
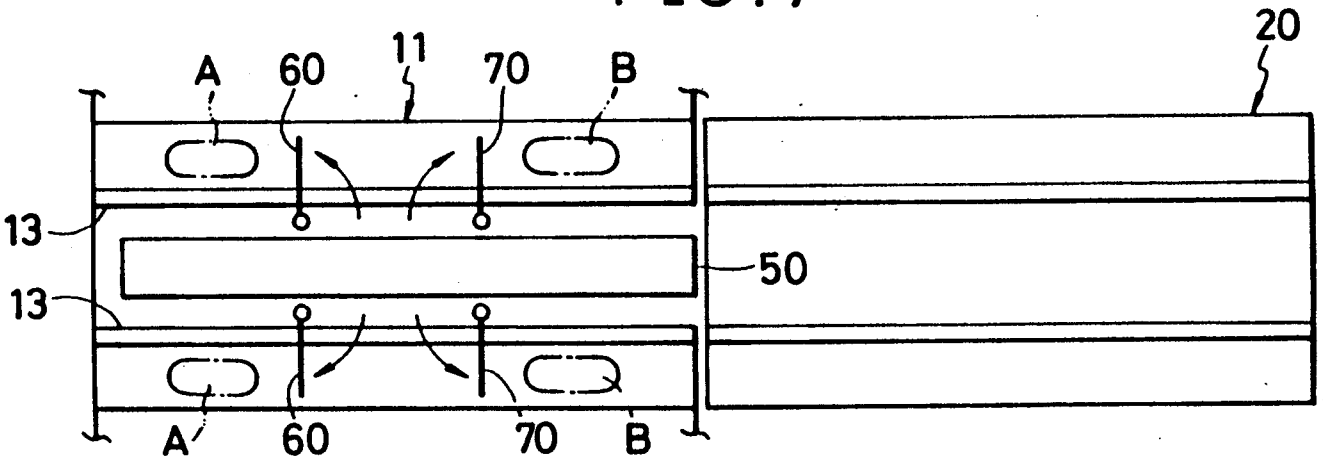
FIG. 7 is a plan view of the parking garage showing a vehicle conveyer when the respective catcher arm is being moved into position in the parking space of the garage.

As shown with FIG. 7, the shifter 50 is positioned beneath the vehicle 30. The shifter 50 rises perpendicularly toward the undersurface of the vehicle 30 without contacting the vehicle 30. The respective catcher arms 60 and 70 are designed so as to open until the prongs 62 are parallel to the rails 13 and the grooves 15 on the plates 14 of the parking space 11. The prongs 62 become aligned with the grooves 15.

DESCENDING THE SHIFTER 50

As shown within FIG. 4, after the respective catcher arms 60 and 70 open, the shifter 50 descends. With the descent of the shifter 50, the catcher arms 60 and 70 descend so that the prongs 62 of the catcher arms enter the grooves 15 on the surface of the plate 14.

SECURING THE TIRES OF THE VEHICLE 30

In order to move the vehicle, it is necessary to fix or secure the tires of the vehicle 30. The front opened catcher arms 60 shift backward and the rear opened catcher arms 70 shift forward as shown by the arrows in FIG. 8. The catcher arms are then positioned beneath the tire positions A, A', B and B'.

Figure 9:
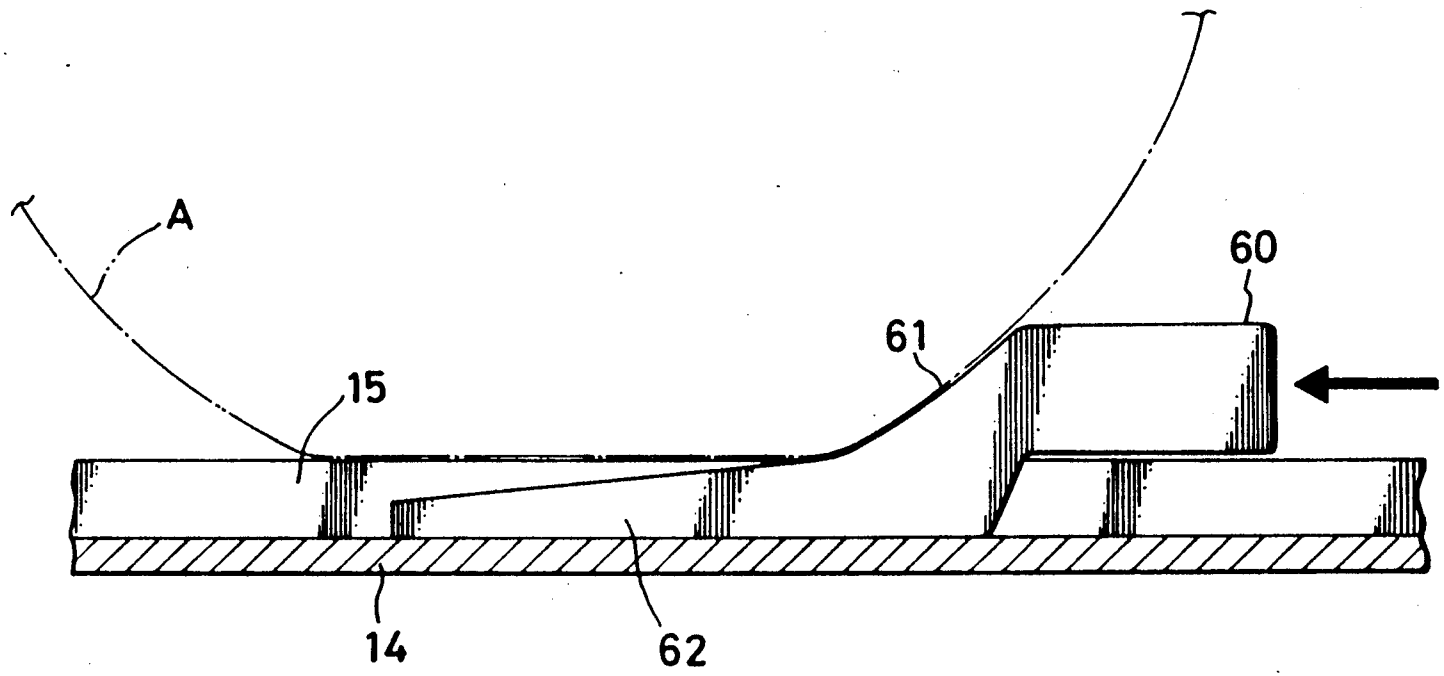
FIG. 9 is a cross-sectional plan view of a catcher arm showing the mechanism which provides for the fixing of a tire of a vehicle.
Figure 10:
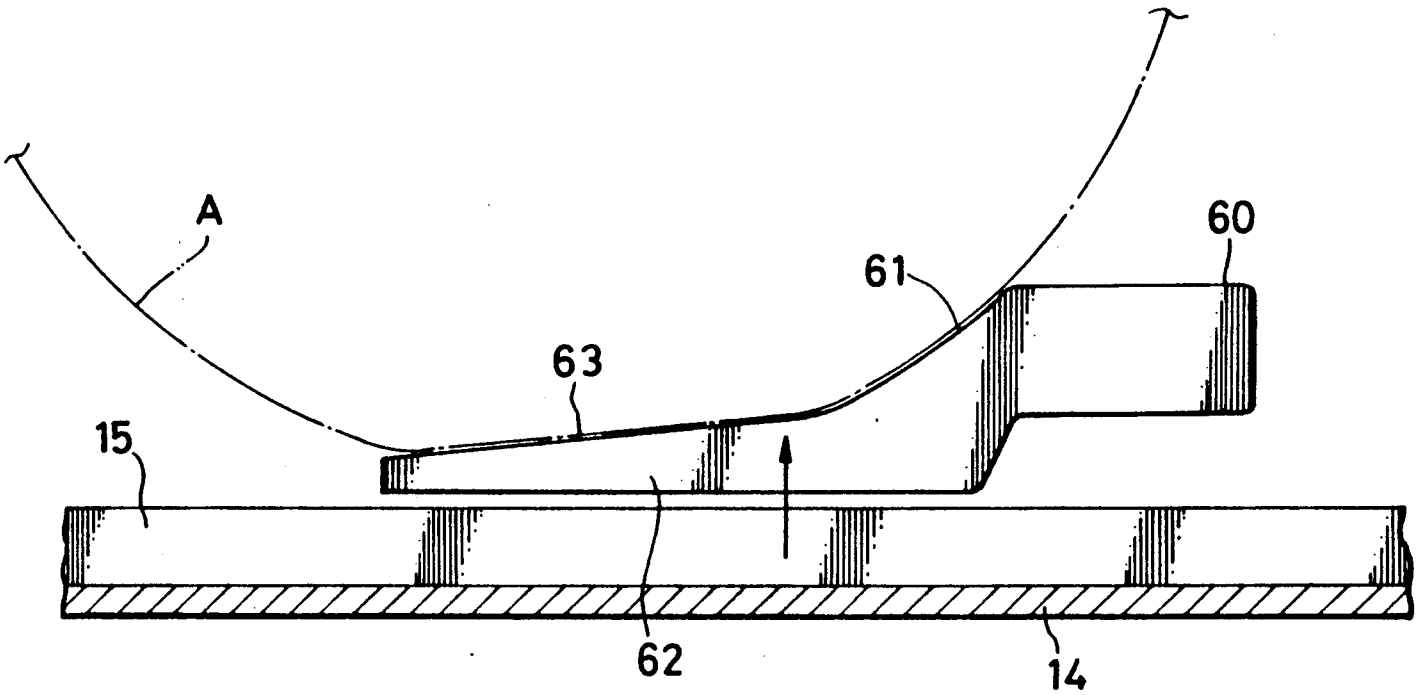
FIG. 10 is a cross-sectional plan view of a catcher arm showing the mechanism which provides for the fixing and thereafter lifting of the tire of a vehicle.

Once the catcher arms are correctly positioned beneath the tires, the tires can be secured as shown within FIG. 9. The catcher arm 60 shifts backward in the direction of the arrow toward a front tire A on the plate 14 and the vehicle fixing surface 61 of the front catcher arm 60 contacts and fixes or secures the surface of the front tire A while the prongs 62 enter the grooves 15 on the surface of the plate 14. Accordingly, the prongs 62 in the grooves 15 do not contact the tire of the vehicle 30. The catcher arm 60 on the opposite side of the vehicle 30 operates in a similar. Further, the catcher arms 70 shift forward to fix the front tires positioned between locations B and B' in a similar manner. Accordingly, the two pairs of catcher arms 60 and 70 secure the tires of the vehicle 30 into position by pressing the vehicle fixing surface 61 of the catcher arms 60. At this point in the operation, the load of the vehicle 30 is largely supported by the four fixing surfaces 61 on the four different catcher arms 60.

LIFTING THE VEHICLE

Referring now to FIGS. 1 and 2, a description of how the vehicle 30 may be moved vertically can be given. By causing the shifter 50 to rise with the catcher arms 60 and 70, the tires of the vehicle which are positioned above the catcher arms are lifted and the weight of the vehicle is forced upward by the fixing surfaces 61 in combination with the upper surfaces of the prongs 62. The vehicle may be moved relatively quickly in that the combination of the surfaces 61 on each of the catcher arms along with the prongs 62 on each of the catcher arms have secured the vehicle by holding its wheels. Accordingly, the vehicle is moved upward and away from the plates 14. The catcher arms 60 and 70 preferably operate simultaneously so as to avoid any imbalance in the amount of weight provided on any particular surface. The weight of the vehicle is eventually placed on the rails 13 of the parking space through the catcher arms 60 and 70 and the frame 51.

SHIFTING THE VEHICLE FROM THE PARKING SPACE 11

Figure 8:
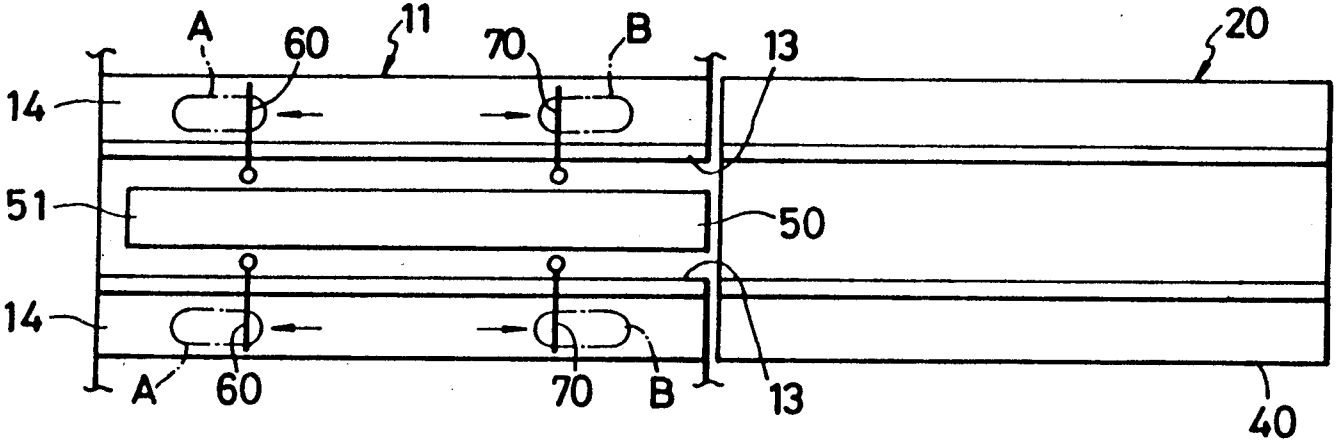
FIG. 8 is a plan view of the parking garage with the vehicle conveyer when the respective catcher arms are fixing the tires of the vehicle in the parking space.
Figure 11:
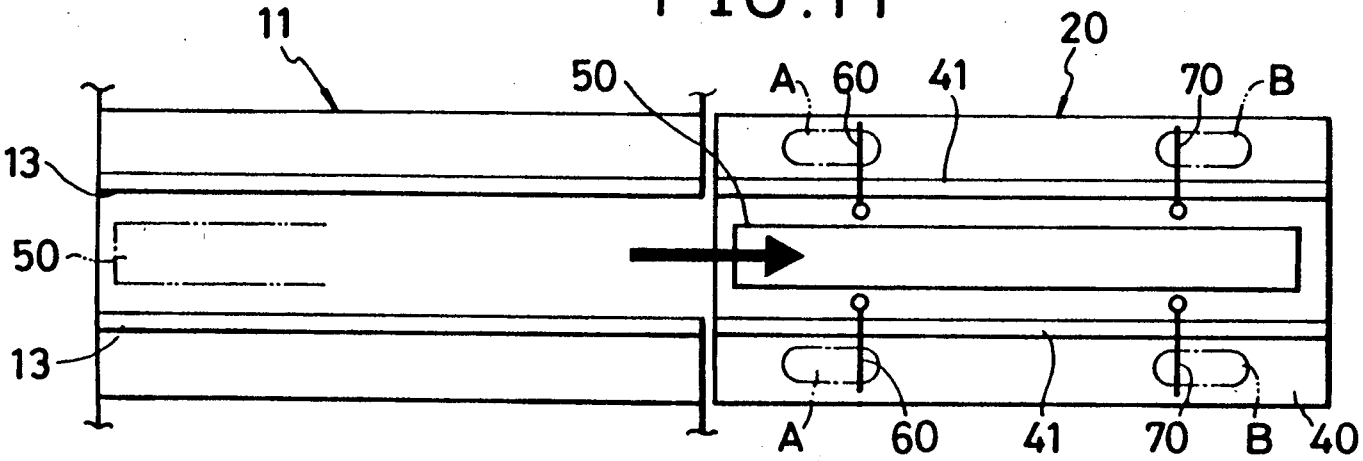
FIG. 11 is a plan view of a parking garage of the invention showing a vehicle conveyer wherein a shifter horizontally moves a vehicle which is in a parking space to a vehicle conveyer.

By referring to FIGS. 8 and 11, the movement of a vehicle to and from its parking space 11 can be described. The catcher arms 60 and 70 lift the vehicle from its parking space 11 and the shifter 50 moves the flat car 40 along the rails 13 and 41. Accordingly, the vehicle on the shifter 50 in the parking space 11 may then be transferred onto the vehicle conveyer 20. The tires of the vehicle can then be fixed by catcher arms 60 and 70 which procedure provides for an efficient high speed movement of the vehicle. The load of the vehicle conveyer 20 having the vehicle thereon is supported by the rails 41 through the catcher arms 60 and 70. In this position, the vehicle conveyer 20 having the vehicle thereon shifts toward the exit of the multi-story garage. The exit and the entrance of the garage are preferably different but may be the same.

ENTERING THE PARKING SPACE 11

As shown within FIGS. 8 and 11, a vehicle (not shown) enters a parking space so that its tires are positioned over the positions B, B', A and A'. The conveyer 20 shifts towards the entrance of the parking garage where the vehicle is positioned. The movements of the catcher arms 60 and 70 and shifter 50 are then carried out in order to vertically lift and horizontally move the vehicle 30. The grooves 15 on the plates 14 of the parking space 11 are provided not only at the entrance area, but at the parking spaces and the exit area so that the vehicle can be moved vertically and horizontally in the same fashion at any place within the multi-story parking garage.

A number of advantages are obtained by utilizing the specific mechanisms and the entire system of the present invention. For example, the catcher arms of the vehicle conveyer, lift the vehicle vertically upward until the surface of the prongs just barely rise above the level of the grooves 15 of the plates 14. Accordingly, the height of the parking garage in accordance with the present invention may be somewhat shorter than that of conventional parking garages which require additional space due to the comb-shaped plates which they utilize. Since the height of the parking garage in accordance with this invention can be smaller, it is possible to build a garage in accordance with this invention which stores more cars within the same cubic area of space as compared with a conventional garage.

The two sets of catcher arms 60 and 70 are capable of fixing the four tires of the vehicle in a secure fashion. Since the tires are held from beneath by the forks 62 and supported by the fixing surfaces 61 the vehicles can be moved at a relatively high rate of speed as compared with the speed at which vehicles are moved in accordance with conventional moving devices within conventional garages.

Due to the configuration of the catcher arms 60 and 70 as well as the shifter 50, the vehicle is moved in a fashion such that it is never in danger of falling. Accordingly, the mechanisms and configurations of the present invention provide improved safety features as compared with conventional multi-story garage mechanisms.

The present invention has been described with reference to particular figures and a particular embodiment. For example, the catcher arms are shifted behind the front tires and from a forward position toward the rear tires in order to fix and lift the tires. However, the catcher arms may be shifted from a position in front of the front tires and from a position behind the rear tires. A number of different possible configurations and methods of movement are possible which are intended to be within the general scope of the present invention. The present invention has been shown and described herein in what was considered to be the most practical and preferred embodiments. It is recognized, however, that departures may be made therefrom which are within the scope of the invention and that obvious modifications will occur to one of ordinary skill in the art upon reading this disclosure; and all such modifications are intended to be encompassed by the attached claims.

What is claimed is:

1. A multi-story parking garage, comprising:

a structure comprised of a plurality of floors with a plurality of parking spaces on each of the floors;

an interconnecting rail system which system allows movement of a car having four wheels between parking spaces and floors wherein the parking spaces include four grooved surfaces each positioned in substantial underlying alignment with a respective one of the four wheels of said car when said car is parked, each of said grooved surfaces comprising a plurality of grooves with each of said grooves having a longitudinal axis substantially parallel to the car's normal path of driven movement;

a vehicle conveyer comprised of a flat car having rollers connected thereto whereby the rollers can move within said interconnecting rail system, the flat car including four positions which are in substantial underlying alignment with a respective one of the four wheels of said car when said car is being conveyed on said vehicle conveyor;

a shifter means positionable below the vehicle conveyor, the shifter means including two pairs of catcher arms pivotally positioned and movable vertically, horizontally and pivotally, the catcher arms each comprising a curved surface area with prongs extending outwardly from each curved surface area in a direction substantially parallel to the grooves of the grooved surfaces and further whereby the width of each of the prongs is equal to or smaller than the width of grooves in the grooved surfaces so that the prongs of the catcher arms fit within the grooves; and a power source and power source conveying means positioned so as to convey power to move the shifter means horizontally and vertically and so as to pivot the catcher arms, so that the prongs move down into and up out of the grooves.

2. A multi-story parking garage as claimed in claim 1, further comprising electronic detector means for detecting the position of components and conveying a signal to the power source based on the position.

3. A multi-story parking garage as claimed in claim 1, wherein the power source includes three separate power sources whereby a first power source is connected to a power conveying means capable of moving the shifter horizontally and a second power source connected to a second power conveying means capable of moving the shifter means vertically and a third power source connected to a third power conveying means capable of moving the catcher arms pivotally.

4. A vehicle conveyor system for movement of a car having four wheels along an interconnected track system of a multi-story parking garage having parking spaces therein, which parking spaces include four grooved surface areas positioned each to substantially underlie a respective one of the four wheels of said car whereby each of said grooved surface areas include a plurality of grooves that each have a longitudinal axis extending in a direction substantially parallel to the normal path of a car's driven movement, the conveyer system comprising:

a flat car frame having rollers connected thereto so that the flat car frame can move along the track system;

two pairs of catcher arms pivotally positioned and moveable vertically, horizontally and pivotally relative to the flat car frame, the catcher arms comprising a curved surface area and prongs extending therefrom in a direction substantially parallel to the grooves of the parking spaces wherein the width of the prongs is equal to or smaller than the width of the grooves so that the prongs from each of the catcher arms fit into a groove in each of the four grooved areas whereby said car may be transferred between a position on said flat car frame and a position on one of said parking spaces; and a power source and a power source conveying means positioned such that power may be conveyed from the power source so as to move the flat car frame along the track system and move the catcher arms pivotally vertically and horizontally.

5. The vehicle conveyor system as claimed in claim 4, wherein the flat car frame has four sets of rollers connected thereto and positioned in a rectangular configuration about the frame.

6. The vehicle conveyer system as claimed in claim 4, further comprising an electrical sensor means which is in connection with the catcher arms and is capable of sensing the position of the arms and conveying an electrical signal to the power source based on the position of the catcher arms.

7. The vehicle conveyer system as claimed in claim 4, wherein the catcher arms provide an arc-shaped surface for securing a car tire in place and further include fork-shaped prongs which when positioned in the grooves do not protrude above the surface area in which the grooves are provided.

* * * * *